United States Patent [19]

Hughes et al.

[11] Patent Number: 4,642,842

[45] Date of Patent: Feb. 17, 1987

[54] ROTARY SCRUBBER WITH INWARDLY RETRACTABLE FOAM EXTRACTOR RING MOUNT

[75] Inventors: Robert R. Hughes, Lutherville, Md.; Robert G. Scott, Lemont, Ill.

[73] Assignee: Chemical Specialities Manufacturing Corporation, Baltimore, Md.

[21] Appl. No.: 790,248

[22] Filed: Oct. 22, 1985

[51] Int. Cl.[4] ..... A47L 5/34

[52] U.S. Cl. ..... 15/359; 15/385

[58] Field of Search ..... 15/354, 320, 359, 385

[56] References Cited

U.S. PATENT DOCUMENTS

| | | | |
|---|---|---|---|
| 1,673,529 | 6/1928 | Ponselle | 15/385 X |
| 2,250,177 | 7/1941 | Boccasile | 15/320 |
| 3,351,972 | 11/1967 | Helm | 15/385 |
| 3,686,707 | 8/1972 | Hughes et al. | 15/320 X |

*Primary Examiner*—Ronald Feldbaum

*Attorney, Agent, or Firm*—Harvey B. Jacobson

[57] ABSTRACT

A rotary scrubber-polisher base has a pair of vacuum liquid pickup attachment supporting mounts mounted from opposite side portions of the base and including laterally outwardly projecting mounting shanks for support of opposite side portions of the attachment therefrom. During periods of non-use of the attachment the latter is removed, but the mounting shanks therefor project outwardly from opposite sides of the scrubber-polisher base and thus prevent those opposite sides from moving into close proximity relative to stationary objects. The mounts are supported from the base in a manner such that they may be readily angularly displaced approximately 90° relative to the base to thereby swing the mounting shanks fully inwardly of the opposite side peripheral portions of the base from which the mounts are supported.

8 Claims, 5 Drawing Figures

FIG. 1
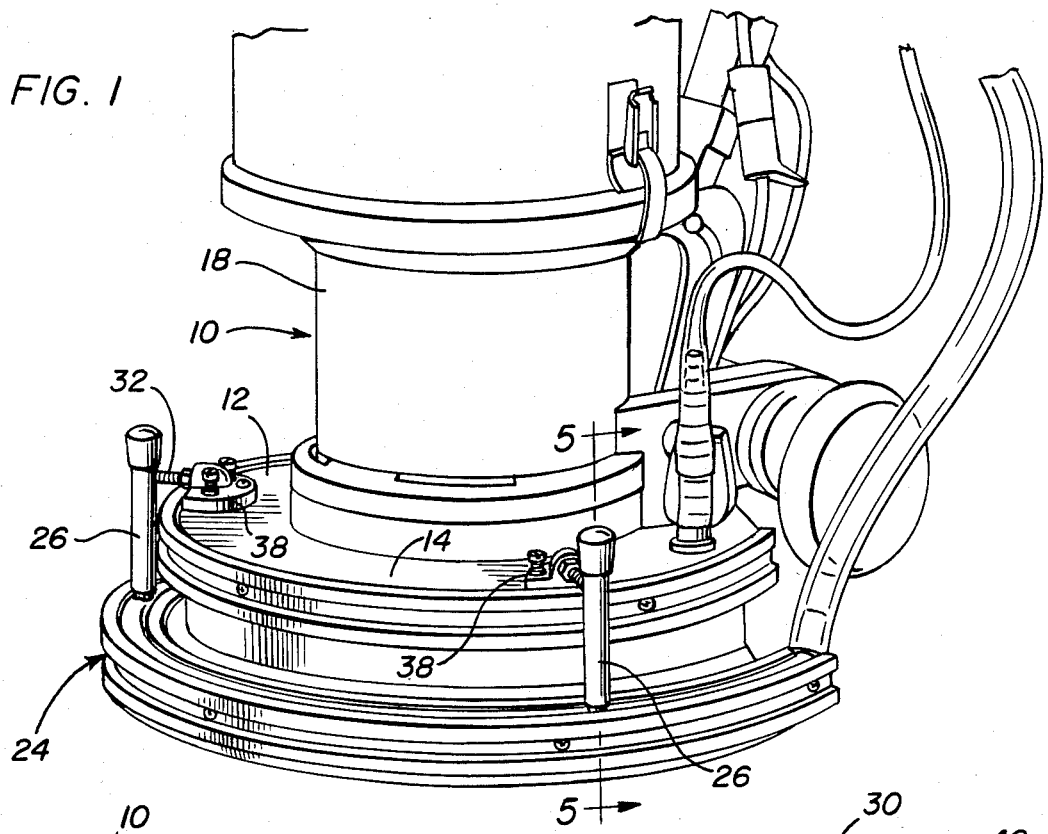
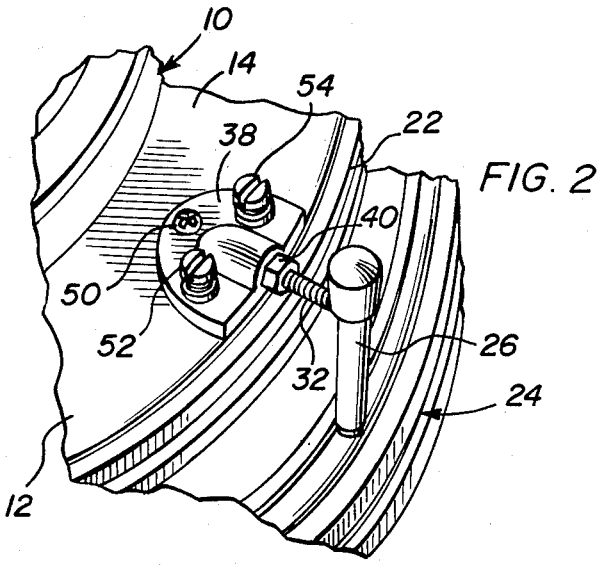
FIG. 2
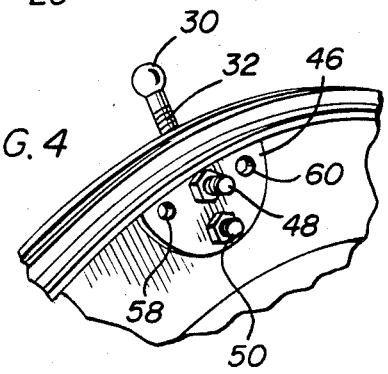
FIG. 4
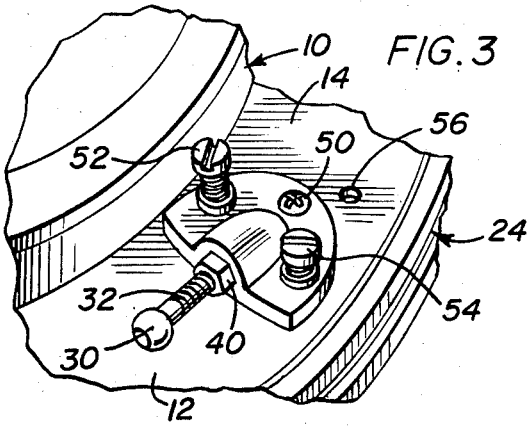
FIG. 3
FIG. 5
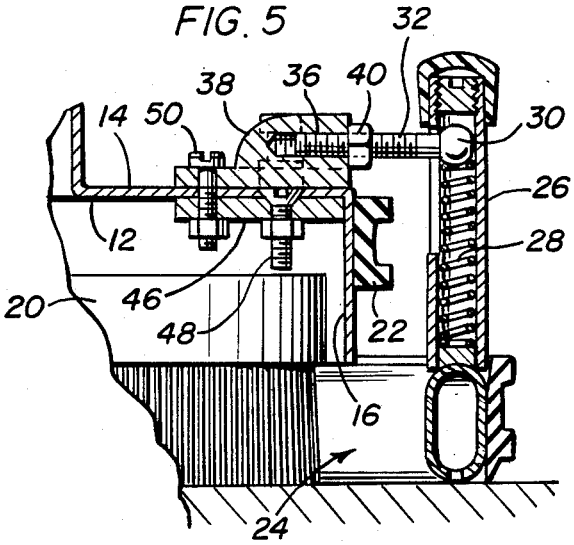

ROTARY SCRUBBER WITH INWARDLY RETRACTABLE FOAM EXTRACTOR RING MOUNT

BACKGROUND OF THE INVENTION

1. Field of the Invention

The instant invention relates to the mounting of opposite side accessory supports from opposite side marginal portions of the base of a rotary scrubber-polisher in a manner such that the supports may be shifted relative to the base from operative positions thereof with accessory supporting portions thereof projecting outwardly from opposite side portions of the base of the scrubber-polisher to retracted positions with tle accessory supporting portions spaced inward of the scrubber-polisher base opposite side portions.

2. Description of Related Art

A rotary scrubber-polisher including accessory supports similar to those incorporated in the instant invention is disclosed in my prior U.S. Pat. No. 3,686,707, dated Aug. 29, 1972.

This previously known form of accessory support includes an outwardly projecting threaded mounting shank equipped with a locknut and threadingly adjustable relative to the associated mounting portion. The accessory support is adapted to mount a vacuum-type foam extractor ring from the body or base of the associated rotary scrubber-polisher in a manner such that the extractor ring is supported in a "floating" manner and whereby the ring is further supported from the scrubber-polisher base for universal shifting relative to the base.

In some instances, the foam extractor ring is not utilized and is removed and the rotary scrubber-polisher is operated in areas closely adjacent stationary objects. The foam extractor ring is releasably mounted from the threaded mounting shanks, but the outer ends of the shanks project outwardly from opposite sides of the scrubber-polisher and thus also must be removed in order to enable the scrubber-polisher to be operated more closely adjacent stationary objects. If the threaded mounting shanks are removed the locknuts thereon must necessarily be loosened and reinstallation of the mounting shanks on the scrubber base the next time the foam extractor ring is to be used requires readjustment of the mounting shanks, which task is time-consuming. Accordingly, a need exists for a means whereby similar opposite side mounting shanks may be supported from the base of a scrubber-polisher in a manner such that the mounting shanks may be readily and quickly shifted to positions inwardly of the opposite side portions of the corresponding scrubber-polisher base and thereafter quickly and readily returned to the outwardly projecting positions thereof independent of specific adjustment of the mounting shanks.

SUMMARY OF THE INVENTION

A pair of support bodies are mounted from opposite sides of the base of a rotary scrubber-polisher and include outwardly projecting threadingly adjustable mounting shank portions from which a vacuum type liquid pickup attachment may be floatingly and universally mounted. The mounting bodies are supported from corresponding side portions of the base for angular displacement about upstanding axes and the mounting bodies each support a pair of manually releasable threaded holddown screws spaced equally from the axis of rotation of the mounting body and disposed on radii thereof angularly displaced approximately 90° apart. When the mounting bodies are in their operative positions with the mounting shanks thereof projecting outwardly of the corresponding sides of the base the holddown screws may be tightened in underlying threaded bores formed in the base. When it is desired to angularly displace the mounting bodies to retracted positions the holddown screws are backed out of the base, only, the mounting bodies are angularly displaced 90° and a first holddown screw of each body is then threadedly engaged in the base threaded bore in which the second holddown screw of that mounting body was previously engaged.

The main object of this invention is to provide opposite side mounts for supporting a vacuum type liquid pickup from the base of a scrubber-polisher and with the mounts being readily shiftable between and securable in extended operative positions and retracted inoperative positions.

Another object of this invention is to provide a pair of opposite side vacuum attachment mounts for a scrubber-polisher that may be readily retrofitted to existing scrubber-polishers.

Still another object of this invention is to provide a pair of vacuum liquid pickup attachment mounts for a scrubber-polisher which may be readily incorporated into the manufacture of various different models of scrubber-polishers.

A final object of this invention to be specifically enumerated herein is to provide retractable opposite side vacuum liquid pickup attachment mounts for scrubber-polishers and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a fragmentary perspective view of a rotary scrubber-polisher with the retractable vacuum type liquid pickup attachment mounts of the instant invention supported from opposite side portions of the base of the scrubber-polisher and in operation supporting a vacuum type liquid pickup attachment from the scrubber-polisher;

FIG. 2 is a fragmentary enlarged perspective view of one side portion of the base of the scrubber and illustrating the attendant vacuum liquid pickup attachment mount in an operative position;

FIG. 3 is a fragmentary perspective view similar to FIG. 2 but illustrating the mount in a retracted position;

FIG. 4 is a fragmentary perspective view illustrating the underside of the assemblage illustrated in FIG. 2, but with the vacuum type liquid pickup attachment removed; and FIG. 5 is a fragmentary enlarged vertical sectional view taken substantially upon the plane indicated by the section line 5—5 of FIG. 1.

DESCRIPTION OF THE PREFERRED EMBODIMENT

Referring now more specifically to the drawings the numeral 10 generally designates a rotary scrubber-polisher such as that disclosed in U.S. Pat. No. 3,686,707. The base 12 of the scrubber-polisher 10 includes a horizontally outwardly extending top wall 14 terminating outwardly in a depending skirt 16, the outer periphery of the top wall and the skirt 16 being partial circular in plan shape. The base 12 supports a drive motor 18 centrally therefrom and it is to be understood that the drive motor 18 includes a gear reduction output shaft projecting downwardly from the top wall 14 and from whose lower terminal end a brush head 20 is removably supported. Furthermore, the skirt 16 includes a resilient bumper strip 22 extending thereabout, all of the foregoing being conventional.

In addition, as disclosed in U.S. Pat. No. 3,686,707, a vacuum type liquid pickup attachment referred to in general by the reference numeral extends about the skirt 16 and somewhat below the latter. Opposite side portions of the attachment include upwardly projecting slotted mounting tubes 26 incorporating internal compression springs 28 and partial spherical end members 30 supported from the outer ends of a pair of threaded mounting shanks 32 are received in the upper ends of the tubes 26 above the compression springs 28 therein, the mounting shanks 32, end members 30 and mounting tubes 26 serving to support the attachment 24 from the base 12 in a floating, universal manner. The inner ends of the mounting shanks 32 are adjustably threadedly engaged in threaded bores 36 formed in support bodies 38 mounted from the top wall 14 and the mounting shanks 32 have locknuts 40 mounted thereon and engageable with the support bodies 38 to retain the mounting shanks 32 in adjusted positions.

A backing plate 46 underlies each opposite side portion of the top wall 14 from which a support bodies 38 is supported and each backing plate 46 is partially secured to the top wall 14 through the utilization of a fastener 48 which is flush with the upper surface of the top wall 14. Each support body 38 is pivotally anchored to the top wall 14 through the utilization of a pivot fastener 50 passing through the support block, the top wall 14 and secured through the backing plate 46. Further, each support body 38 has a pair of coil spring-equipped manually tightenable and loosenable retaining screws 52 and 54 supported therefrom. Each of the screws 52 and 54, when the support bodies 38 are in their operative positions, extends through a corresponding bore 56 formed in the top wall 14 and the screws 52 and 54 are threadedly engaged in threaded bores 58 and 60 formed in the corresponding backing plate 46. When the bodies 38 are secured in this position, the mounting shanks 32 project outwardly of the corresponding sides of the base 12. However, when the attachment 24 is not being used and it is desired to operate the scrubber-polisher 10 in close proximity to stationary objects, the screws 52 and 54 are loosened and upwardly displaced to a level above the top wall 14. Then, the bodies 38 are rotated approximately 90° from the position thereof illustrated in FIG. 2 to the position illustrated in FIG. 3 and the screw 54 is downwardly displaced and threadedly engaged in the threaded bore 58. In this manner, the support bodies 38 are retained in the retracted positions thereof with the mounting shanks 32 spaced fully inwardly of the outer marginal portions of the base 12 defined by the skirt 16.

Each support body 38 may be shifted between the operative and inoperative positions thereof in a matter of seconds and the shifting of the support bodies 38 between the operative and inoperative positions thereof does not require loosening of the mounting shanks 32 and therefore readjustment of the mounting shanks 32 when the support bodies 38 are resecured in their operative positions illustrated in FIG. 2.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a rotary scrubber-polisher of the type including a base centrally beneath which a motor-driven scrubber-polisher head is removably mounted and wherein said base includes an arcuate peripheral portion and an arcuate vacuum pickup attachment removably, floatingly and universally mounted from opposite side supports carried by and projecting outwardly from opposite side portions of said base, the improvement comprising mounting means mounting said supports from said opposite side portions for shifting of said supports relative thereto between operative positions with attachment supporting portions thereof projecting outwardly froms said opposite side portions for removable support of said pickup attachment therefrom and retracted inoperative positions with said attachment supporting portions retracted to positions spaced inwardly of said opposite side portions.

2. The scrubber-polisher of claim 1 wherein said base includes upper surface portions extending inwardly from said opposite side portions, said supports each including a body supported from a corresponding surface portion and including a horizontal outwardly projecting mounting shank comprising the corresponding attachment supporting portion extending horizontally outwardly beyond the corresponding opposite side portion of said base when said support is in said operative position, said mounting means including pivot fastener means pivotally mounting each of said bodies from the corresponding upper surface portion for angular displacement relative thereto about an upstanding axis and pairs of first and second position-retaining gasteners mounted from each support equidistant from the corresponding axis and releasably engageable with said base in corresponding first and second locations thereon when said body is in said operative position, at least one fastener being releasably engageable with the corresponding second location on said base when said body is in said retracted position for releasable retention of said body in said retracted position.

3. The scrubber-polisher of claim 2 wherein said mounting shank comprises a threaded mounting shank threadingly supported from said body.

4. The scrubber-polisher of claim 3 wherein said mounting shank includes a jam nut thereon.

5. The scrubber-polisher of claim 2 wherein said pair of retaining fasteners comprise threaded fasteners.

6. The scrubber-polisher of claim 5 wherein said opposite side portions of said base comprise outer top wall portions of said base, said threaded fasteners being threadedly engaged in backing plates secured to the underside of said top wall portions.

7. The scrubber-polisher of claim 6 wherein said mounting shank comprises a threaded mounting shank threadingly supported from said body.

8. The scrubber-polisher of claim 7 wherein said mounting shank includes a jam nut thereon.

* * * * *